US007029342B2

(12) United States Patent
Mallea

(10) Patent No.: US 7,029,342 B2
(45) Date of Patent: Apr. 18, 2006

(54) REVERSE GATE FLOW DIRECTOR

(76) Inventor: Bruce Mallea, 201 N. Hiawatha Dr., Hailey, ID (US) 83333

( * ) Notice: Subject to any disclaimer, the term of this patent is extended or adjusted under 35 U.S.C. 154(b) by 0 days.

(21) Appl. No.: 10/431,868

(22) Filed: May 7, 2003

(65) Prior Publication Data

US 2004/0224580 A1 Nov. 11, 2004

(51) Int. Cl.
*B63H 11/11* (2006.01)

(52) U.S. Cl. ..... 440/41

(58) Field of Classification Search ..... 440/38, 440/40, 41, 42, 43, 47
See application file for complete search history.

(56) References Cited

U.S. PATENT DOCUMENTS 3,593,343 A * 7/1971 Viggers ..... 623/2.35
3,788,265 A * 1/1974 Moore ..... 440/41
4,538,997 A * 9/1985 Haglund ..... 440/41
5,713,770 A * 2/1998 Ambli ..... 440/41
5,938,398 A * 8/1999 Brown ..... 414/607
6,000,095 A * 12/1999 Johnson ..... 15/316.1
6,428,370 B1 * 8/2002 Jones ..... 440/38
6,629,866 B1 * 10/2003 Burg ..... 440/38
6,722,932 B1 * 4/2004 Yanagihara ..... 440/41
2004/0009041 A1 * 1/2004 Aughton et al. ..... 405/99

* cited by examiner

*Primary Examiner*—Stephen Avila
(74) *Attorney, Agent, or Firm*—James E. Parris

(57) ABSTRACT

A reverse gate flow director comprising a flow director base plate of generally trapezoidal shape, having mounting holes, a leading edge and a trailing edge configured to minimize water turbulence, a flow director fin of generally rectangular shape, having a leading edge and a trailing edge configured to minimize water turbulence, to direct water output flow from a reverse gate exit port and configured for fitting inside a reverse gate exit port having a reverse gate deflection feature with mounting holes for fixedly attaching the flow director base plate thereto.

20 Claims, 7 Drawing Sheets

REVERSE GATE FLOW DIRECTOR

FIELD OF THE INVENTION

The present invention relates to the field of improved jet boat reverse thrust and, more particularly, to a flow director for attaching to a reverse gate to improve reverse thrust by reducing flow dispersion and directing reverse gate water flow.

BACKGROUND OF THE INVENTION

Jet boat forward thrust is enabled using a jet pump for accelerating water away from the jet boat stern-panel to accelerate the boat forward. Jet boat reverse thrust is enabled by redirecting the jet pump thrust towards the jet boat stern-panel to accelerate the boat backward. Redirecting the jet pump thrust is enabled using a "reverse gate", where a reverse gate is a semi-circular cavity that is pivoted into the jet pump flow-stream to redirect water flow to the opposite direction and create reverse thrust as shown by Jones et. al (U.S. Pat. No. 5,752,864), who teaches a reverse gate for pivoting into a jet pump flow-stream for personal watercraft to enable reverse operation. While personal watercraft generally do not have a stern-panel, stern-panels are common to jet boats and other larger vessels.

It is common for reverse gate devices to be used with jet boats for enabling reverse thrust. When attached to jet pumps of jet boats, the reverse gate redirects the water flow to the stern-panel, and the exit port disperses the flow-stream in a generally wide pattern. The reverse gate flow-stream rapidly decelerates by having a disperse output, thus reducing the reverse capabilities of the jet boat. Additionally, a substantial portion of the dispersed water flow from the reverse gate flow-stream is directed into the jet boat stern-panel where it terminates, further reducing the reverse capabilities of the jet boat. The portion of the water that does not terminate into the stern-panel moves beneath the jet boat hull and slowly propels the boat in reverse direction. The dispersed flow-stream is unsuitable for reverse steering when operating the jet pump steering nozzle.

The current method of addressing these barriers is to operate the jet pump in a high-output mode to slowly reverse. Such operation is undesirable to jet boat enthusiasts who generally think it to be inadequate reverse thrust for the horsepower expended and a process where greater efficiency is needed.

SUMMARY OF THE INVENTION

The present invention is a reverse gate flow director for fixedly attaching to a reverse gate mechanism on a jet boat. The reverse gate flow director has a surface area sufficient to direct water flow from a reverse gate to improve reverse thrust. The reverse gate flow director, having mounting holes is fixedly coupled to the reverse gate. The reverse gate flow director has features that fit inside the reverse gate cavity so as to minimize any induced turbulence and features that extend about 3-inches from the reverse gate exit port to direct reverse gate flow. The flow director is made from material having sufficient strength and corrosion resistance for redirecting water from a reverse gate, and having coupling mechanisms of sufficient strength to fixedly mount the flow director to the reverse gate. The flow director projection is about 3-inches from exit port of the reverse gate, optimized for improved flow direction in an engaged mode and reduced forward frictional drag when in a disengaged mode.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
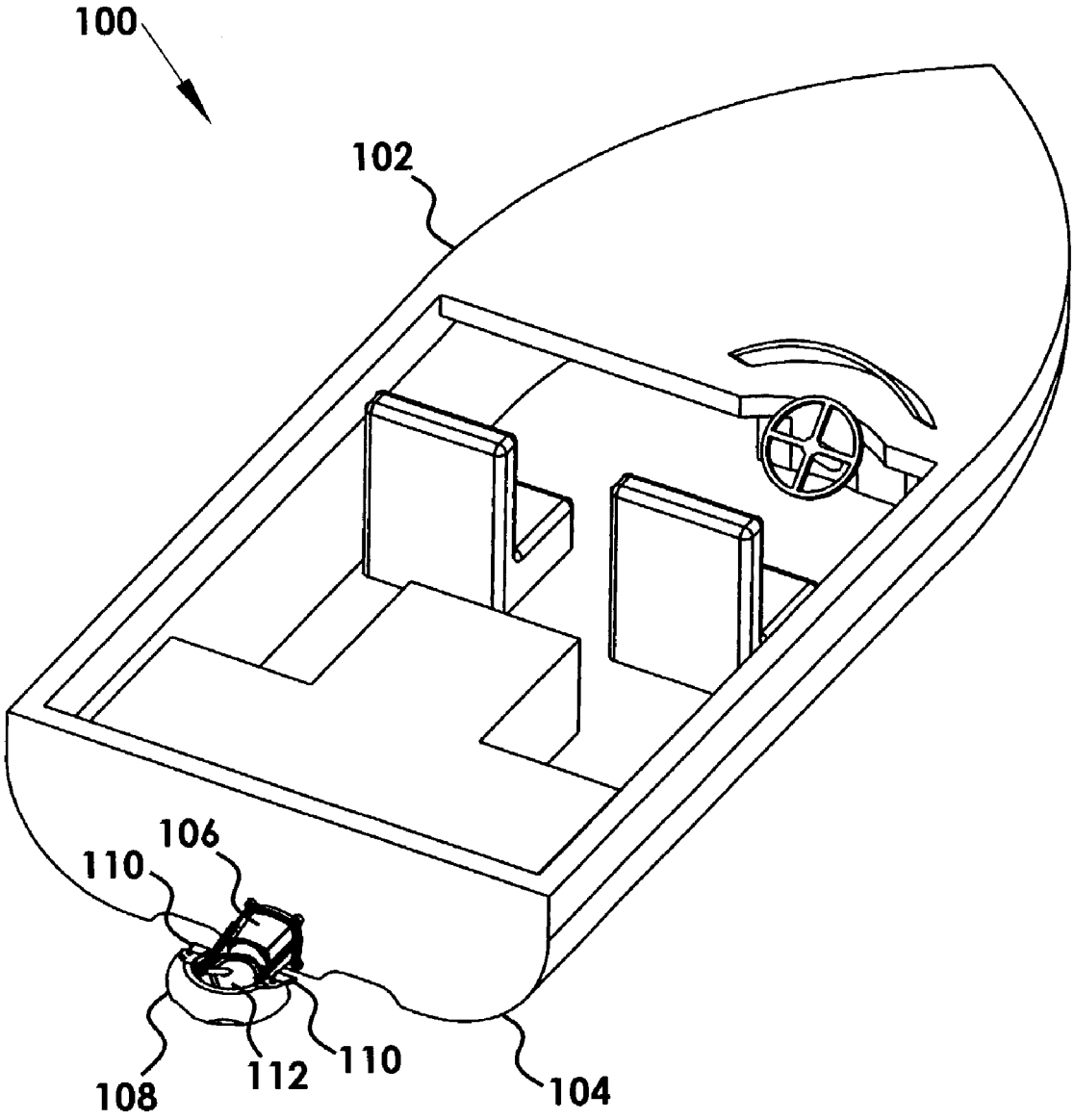
FIG. 1 depicts an environment where the current invention typically operates.

Referring now to the drawings. FIG. 1 depicts a perspective view of a typical environment 100 in which the current invention operates, where a jet boat 102 includes a stern-panel 104, a jet pump housing 106 and a reverse gate 108. The reverse gate 108 is configured for fixedly holding a reverse gate flow director 111. Show is the jet pump housing 106 projecting from the stern-panel 104 of the jet boat 102. A jet pump comprises the jet pump housing 106 and an impeller (not shown) driven by a motor (not shown) to accelerate water from the jet pump housing 106 through a steering nozzle 112 and create thrust to the jet boat 102. As depicted, the reverse gate 108 is configured on the jet pump housing 106 for enabling reverse thrust to the jet boat 102. The reverse gate 108 enables reverse thrust when it is pivoted into the jet pump water stream to channel water thrust along the reverse gate cavity 116, and out the reverse gate exit port 114 (see FIG. 4*a*) in the reversing direction. The reverse gate flow director 110 invention reduces premature dispersion of the reverse thrust water by facilitating laminar flow of reverse water thrust and directing the water thrust beneath and around the jet boat stern-panel 104. The reverse gate flow director 110 reduces the amount of water thrust that terminates into the stern-panel 104 and the degree to which the reverse thrust water disperses, thus enabling an improved reverse thrust to the jet boat 102. The attributes of the reverse gate flow director 110 invention and how it improves reverse thrust as are made more evident below.

Figure 2A:
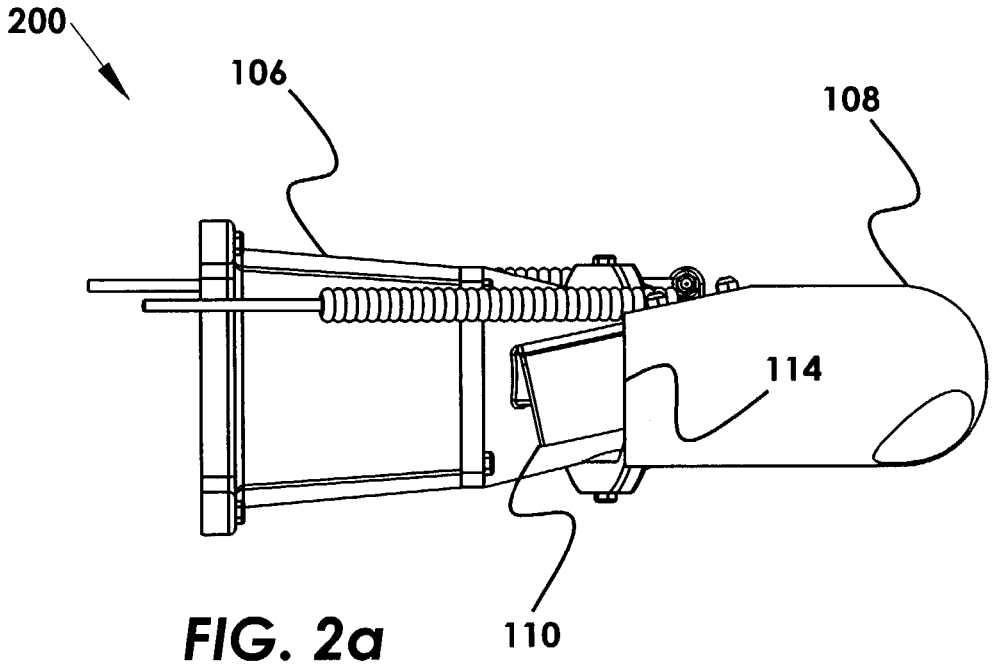
FIG. 2*a* depicts a side view of the reverse gate flow director fixedly attached to a reverse gate positioned on the jet pump for reverse thrust operation extending from a cutaway depiction of a jet boat stern-panel.
Figure 2B:
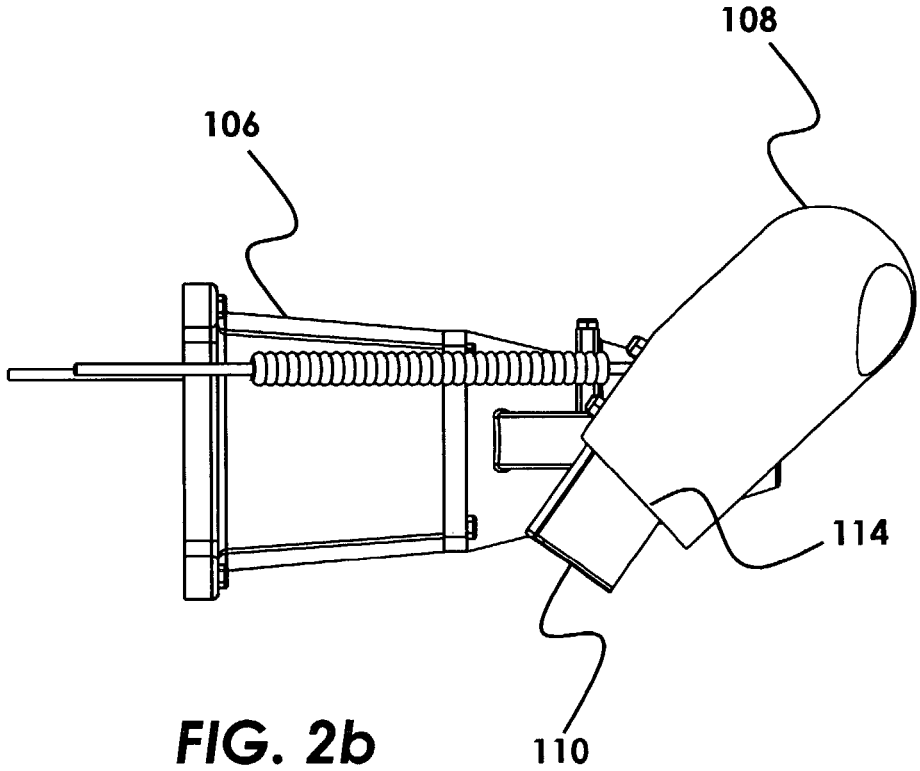
FIG. 2*b* depicts a side view of the reverse gate flow director fixedly attached to a reverse gate positioned on the jet pump for forward thrust operation extending from a cutaway depiction of a jet boat stern-panel.

FIG. 2*a* and FIG. 2*b* depict side views of the reverse gate flow director 110 fixedly attached to a reverse gate 108 mounted to the jet pump housing 106. FIG. 2*a* depicts the reverse gate 108 configured for reverse thrust operation positioned on the jet pump housing 106 in the "down" position into the jet pump output water (not shown). As depicted, the reverse gate flow director 110 projects about 3-inches from the edge of the reverse gate exit port 114 to direct reverse flow and ensure optimum reverse thrust. FIG. 2*b* depicts the reverse gate 108 in a "raised" position on the jet pump housing 106 for forward thrust operation such that the reverse gate 108 is position away from the water thrust stream (not shown) to enable the jet pump output water to propel the jet boat 102 forward. The reverse gate flow director 110 is depicted to project about 3-inches from the edge of the reverse gate exit port 114. The projection length is to optimize reverse flow action while the reverse gate 108 is positioned in the "down" position on the jet pump housing 106 and to minimize forward impedance from the jet pump flow director 110 while positioned in the forward "raised" position, where a projection length too long will drag through trough the water below the jet boat 102 hull.

Figure 3A:
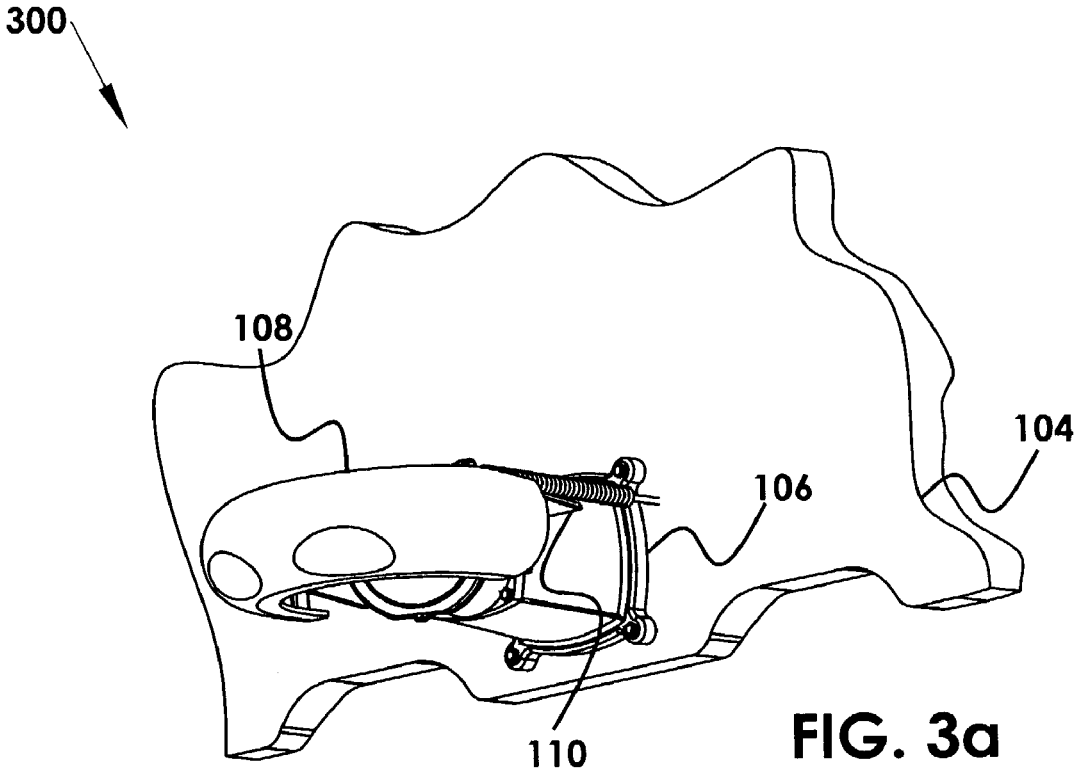
FIG. 3*a* depicts a perspective view of the reverse gate flow director fixedly attached to a reverse gate positioned on the jet pump for reverse thrust operation extending from a cutaway depiction of a jet boat stern-panel.
Figure 3B:
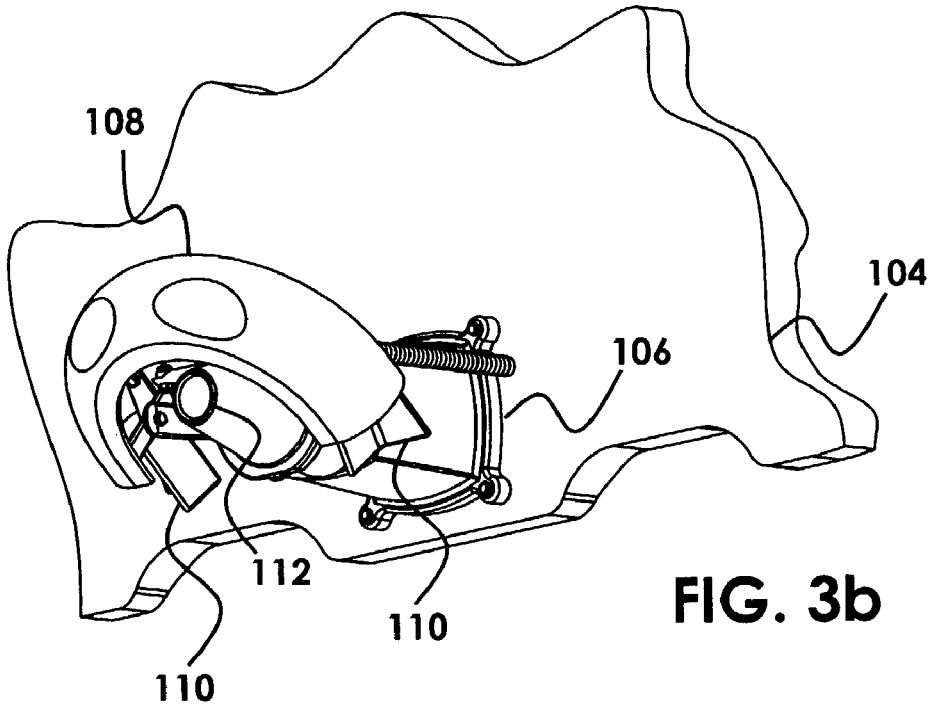
FIG. 3*b* depicts a perspective view of the reverse gate flow director fixedly attached to the reverse gate positioned on the jet pump for forward thrust operation extending from a cutaway depiction of a jet boat stern-panel.

FIG. 3*a* and FIG. 3*b* depict perspective views of the reverse gate flow director 110 fixedly attached to a reverse gate 108 mounted to the jet pump housing 106 extending from a cut-away depiction of a stern-panel 104 of the jet boat 102. FIG. 3*a* depicts the reverse gate 108 positioned for reverse thrust operation on the jet pump housing 106, and the stern-panel 104 is depicted as a cut-away portion of the jet boat 102. The reverse gate 108 is shown positioned directly in the flow path of the jet pump output water to redirect the flow path in the opposite direction and create reverse thrust for reversing action. FIG. 3*b* depicts the reverse gate 108 positioned away from the jet pump flow stream for jet boat 102 forward thrust operation, and the stern-panel 104 is depicted as a cut-away portion of the jet boat 102. Here, the output water (not shown) emitted from the jet pump steering nozzle 112 is shown to be unabated by the reverse gate 108 to enable forward thrust to the jet boat 102.

Figure 4A:
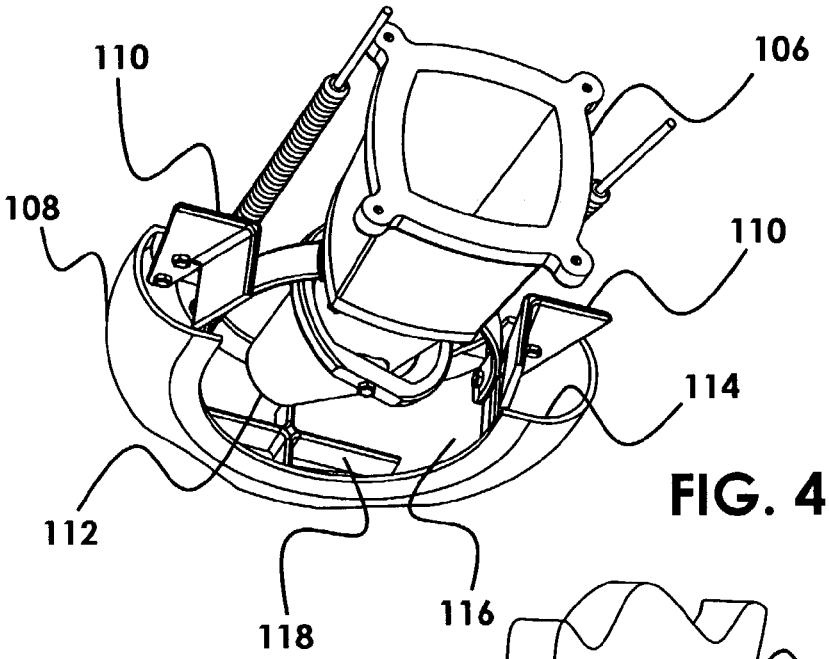
FIG. 4*a* depicts a perspective view of the reverse gate flow director fixedly attached to the reverse gate for reverse thrust operation on the jet pump having a steering nozzle turned to demonstrate reverse steering.
Figure 4B:
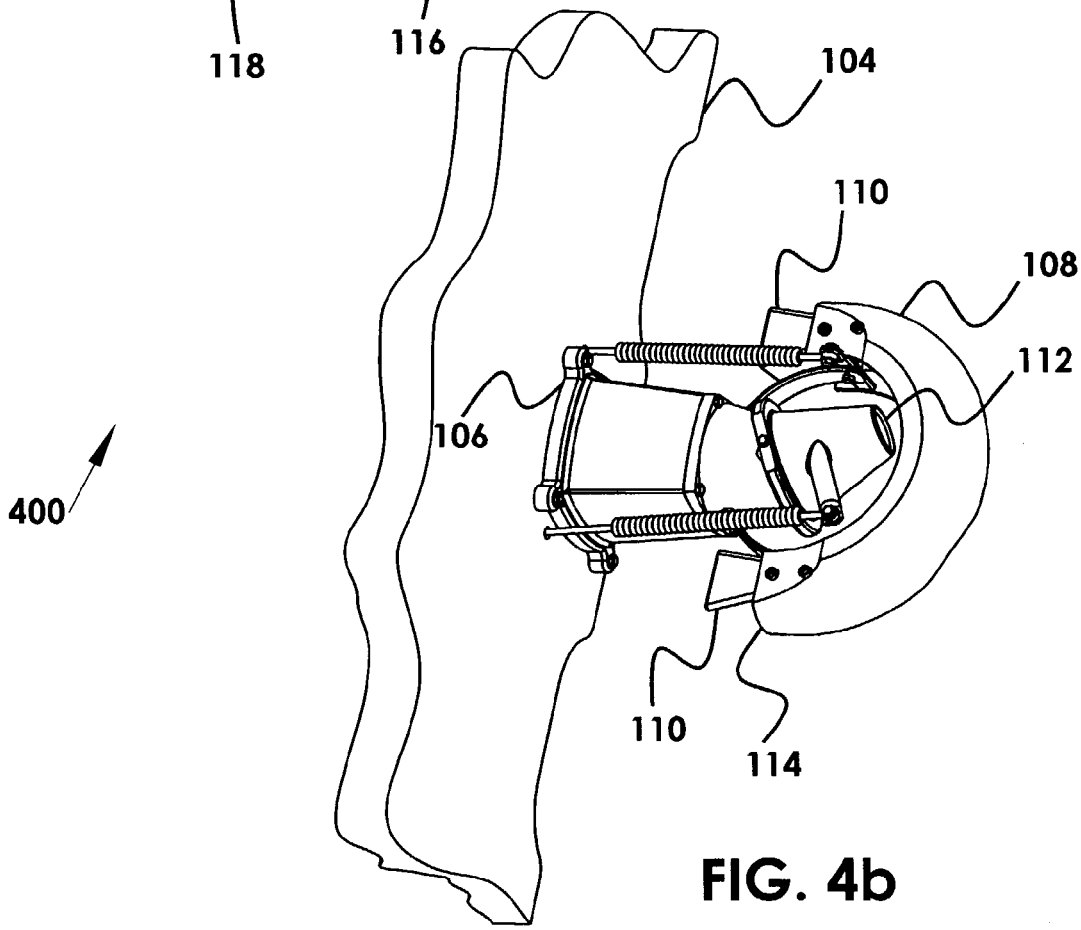
FIG. 4*b* depicts a perspective view of the reverse gate flow director fixedly attached to the reverse gate for reverse thrust operation on a jet pump extending from a cutaway jet boat stern-panel where a steering nozzle demonstrates reverse steering.

FIG. 4*a* and FIG. 4*b* depict perspective views of the reverse gate flow director 110 fixedly attached to a reverse gate 108 oriented for reverse thrust operation on the jet pump housing 106 having a steering nozzle 112 oriented to illustrate reverse steering. As depicted in FIG. 4*a*, the jet pump housing 106 is removed from the motor (not shown) and impeller (not shown), and the reverse gate cavity 116 is shown having reverse gate separator fins 118 and positioned for reverse thrust operation on the jet pump housing 106. Here, the jet pump steering nozzle 112 is shown oriented for enabling steering operation while the reverse gate 108 is in reverse position. The reverse gate 108 includes reverse gate separator fins 118 located in the reverse gate cavity 116 and used for diverting jet pump water flow along the reverse gate cavity 116 to emit from the reverse gate exit port 114. As depicted in FIG. 4*a* the jet pump steering nozzle 112 points to the starboard side of the reverse gate separator fins 118. In this orientation, the reverse thrust will emit primarily from the starboard side of the reverse gate 108 because the reverse gate separator fins 118 impede the water flow from emitting from the port side of the reverse gate exit port 114, thus causing the jet boat 102 to reverse towards the port side of jet boat 102. Alternatively, but not depicted, turning the nozzle 112 towards the port side of the reverse gate 108 will cause the reverse thrust to emit primarily from the port side of the reverse gate 108, and thus reverse the jet boat 102 toward the starboard side of the jet boat 102 during reverse operation. Reverse steering is enabled by the reverse gate flow director 110 inducing laminar flow to the turbulent flow occurring when the jet pump steering nozzle 112 is moved from a centered position on the reverse gate separator fins 118 located in the reverse gate cavity 116. The turbulence occurs as the jet pump flow nozzle 112 is positioned off-center to direct the jet pump water flow to one side of the reverse gate 108 where a portion of the water flow is directed along the reverse gate cavity 116 and out the reverse gate exit port 114, and the remaining portion of the water flow is directed into the side of the reverse gate separator fins 118, which is then reflected back to the reverse gate exit port 114. The reflected water provides interference to the overall water flow and thus induces greater turbulence. In the absence of the reverse gate flow directors 110, the turbulent water flow lacks sufficient laminar flow to provide reverse thrust for steering, and the turbulent water emitting from the reverse gate exit port 114 disperses in too wide of a pattern without providing enough thrust to enable reverse steering. Reverse steering operation is enabled by the reverse gate flow director 110 inducing laminar flow to the turbulent water created when the jet pump nozzle 112 is moved from the centered position and reflects off the reverse gate separator fin 118. Additionally, the reverse gate flow director 110 directs the reverse flow to a narrower output pattern to provide greater reverse thrust and enable reverse steering. More specifically, as depicted in FIG. 4*a*, the jet pump flow director 10 having a flow director fin 128 attached to the base plate 120 at an angle suitable to conforming to the inner reverse gate exit port 114 profile, creates a deflection of the output water to redirect the flow to a focused flow output reducing stern-panel 104 interaction.

FIG. 4*b* depicts a jet pump housing 116 extending from a cutaway depiction of a stern-panel 104 with the steering nozzle 112 positioned for reverse steering operation of the jet boat 102. As depicted, the jet pump steering nozzle 112 is positioned to the starboard side of the jet boat 102 stern-panel 104 to enable reverse steering towards the port side of the jet boat 102. The reverse gate flow directors 110 are depicted to extend about 3-inches from the exit port 114 of the reverse gate 108. The reverse gate flow directors 110 facilitate laminar flow of the reverse thrust water and direct the reverse thrust water flow below and around the stern-panel 104.

Figure 5A:
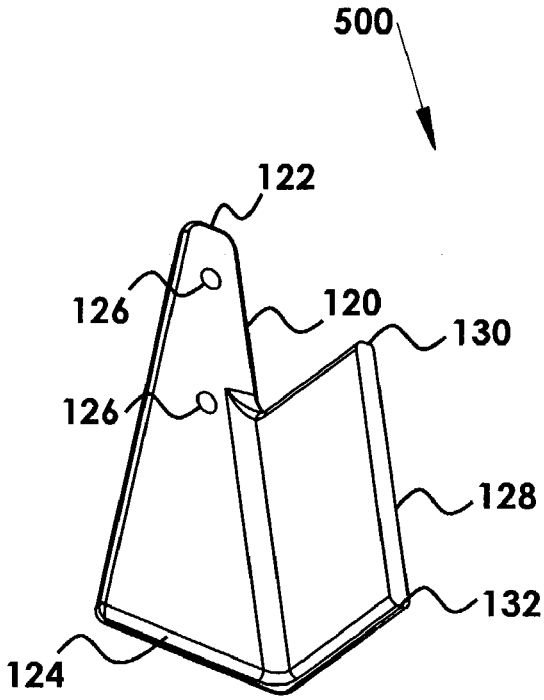
FIG. 5*a* is a perspective view of a preferred embodiment of the reverse gate flow director having a flow director base plate and a flow director fin.

FIG. 5*a* depicts a perspective view of a preferred embodiment of the current invention. As shown, the preferred embodiment comprises a flow director base plate 120, of generally trapezoidal shape, having a base plate leading edge 122 at the minor trapezoid end and a base plate trailing edge 124 at the major trapezoid end, each shaped to minimize turbulence and induce laminar flow. The preferred embodiment of the current invention further comprises a first base plate mounting hole 126 about 1-inch below the base plate leading edge of the flow director 110 and a second base plate mounting hole 126 having a center about 1½-inches from the center of the first base plate mounting hole 126, where the base plate mounting holes 126 are aligned along the water flow path (not shown). The preferred embodiment of the current invention further comprises a flow director fin 128 of generally rectangular shape and positioned about ⅔ along one side of the down stream length of the base plate 120, having a flow director fin leading edge 130 beginning about ⅓ along the flow director base plate 120 length from the base plate leading edge 122, and a flow director fin trailing edge 132, terminating at the base plate trailing edge 124, each edge shaped to minimize turbulence, where the flow director fin 128 laterally directs the reverse thrust water towards a side of the stern-panel 104. Further, the flow director fin 128 enables improved steering during reverse thrust operation by improving the laminar flow of the reverse thrust water stream (not shown) and directing the output flow to reduce stern-panel 104 interaction. Additionally, the flow director base plate 120 is configured to improve laminar flow of reverse thrust water (not shown) and configured to focus reverse thrust water below the stern-panel 104 for improved jet boat 102 reverse operation.

Figure 5B:
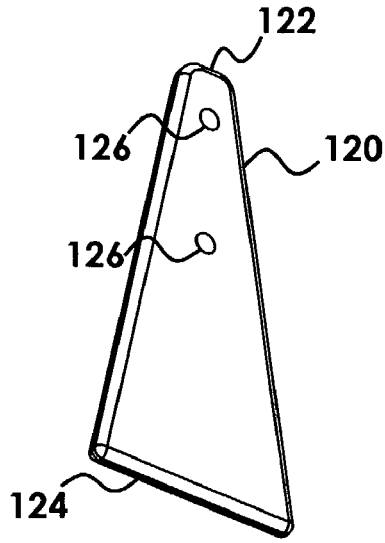
FIG. 5*b* is a perspective view of an alternate embodiment of the reverse gate flow director having a flow director base plate.

FIG. 5*b* is a perspective view of an alternate embodiment of the current invention, comprising a flow director base plate 120 of generally trapezoidal shape, having a base plate leading edge 122 at the minor trapezoid end and a base plate trailing edge 124 at the major trapezoid end, each edge shaped to minimize turbulence, and a first base plate mounting hole 126 about 1-inch below the leading edge of the flow director 110 and a second base plate mounting hole 126 having a center about 1½-inches from the center of the first base plate mounting hole 126, where the base plate mounting hole 126 are aligned along the water flow path (not shown). The alternate embodiment depicted in FIG. 5*b* is configured to improve laminar flow of reverse thrust water and configured to direct reverse thrust water below the stern-panel 104 for improved jet boat 102 reverse operation.

Figure 5C:
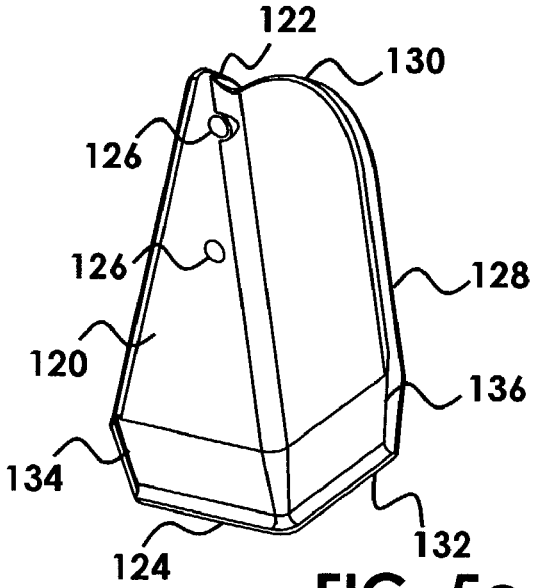
FIG. 5*c* is a perspective view of an alternate embodiment of the reverse gate flow director having an angled base plate deflector and on an angled fin plate deflector.

FIG. 5*c* depicts a perspective view of an alternate embodiment of the invention. As shown, the alternate embodiment comprises a flow director base plate 120, of generally trapezoidal shape, having a base plate leading edge 122 at the minor trapezoid end and a base plate trailing edge 124 at the major trapezoid end, each edge shaped to minimize turbulence, and a first base plate mounting hole 126 about 1-inch below the base plate leading edge 122 and a second base plate mounting hole 126 having a center about 1½-inches from the center of the first base plate mounting hole 126, where the base plate mounting holes 126 are aligned along the water flow path (not shown). The alternate embodiment further comprises a flow director fin 128 having a flow director fin leading edge 130 beginning at the base plate leading edge 122, and a flow director fin trailing edge 132 terminating at the base plate trailing edge 124 each edge shaped to minimize turbulence, where the flow director fin 128 laterally directs the reverse thrust water (not shown) towards the starboard and port sides of the stern-panel 104. Further, the flow director fin 128 enables improved steering during reverse thrust operation by creating a more laminar and directed flow of the reverse thrust water stream (not shown). The flow director base plate 120 is configured to improve laminar flow of reverse thrust water (not shown) and configured to direct reverse thrust water (not shown) below the stern-panel 104 for improved jet boat 102 reverse operation. Further, the flow director 110 base plate 120 has an angled base plate deflector 134 extending from the flow director trailing edge 124 and flow director fin 128 extending form the flow director fin trailing edge 132 has an angled fin plate deflector 136, configured to enhance the vertical and lateral directing of reverse thrust water (not shown) beneath the stern-panel 104 and towards the starboard and port sides of the stern-panel 104. The flow director base plate 120 having an angled base plate deflector 134 and the flow director fin 128 having an angled fin plate deflector 136 enables improved steering during reverse thrust operation by creating a more focused and laminar flow of the reverse thrust water stream (not shown).

Figure 5D:
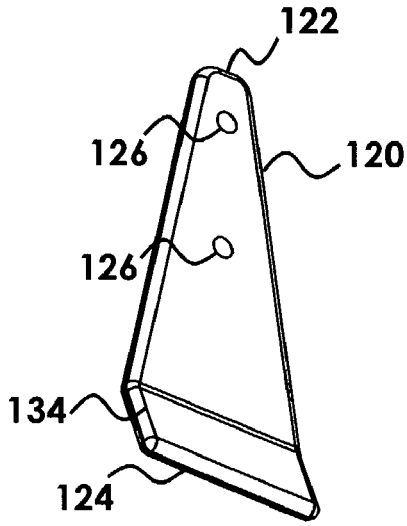
FIG. 5*d* is a perspective view of an alternate embodiment of the reverse gate flow director having an angled base plate deflector.

FIG. 5*d* is a perspective view of an alternate embodiment of the current invention, comprising a flow director base plate 120 of generally trapezoidal shape, having a base plate leading edge 122 at the minor trapezoid end and a base plate trailing edge 124 at the major trapezoid end, each edge shaped to minimize turbulence, and a first base plate mounting hole 126 about 1-inch below the base plate leading edge 122 and a second base plate mounting hole 126 having a center about 1½-inches from the center of the first flow director 110 mounting hole, where the base plate mounting holes 126 are aligned along the water flow path (not shown). Additionally, the alternate embodiment of the current invention has an angled base plate deflector 134 configured to enhance the vertical directing of reverse thrust water (not shown) below the stern-panel 104.

Figure 6A:
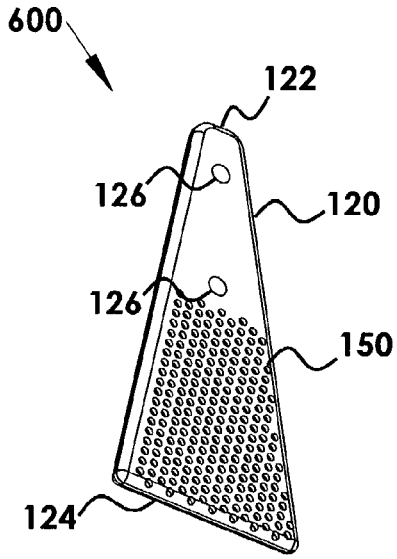
FIG. 6*a* is a perspective view of an alternate embodiment of the reverse gate flow director having a dimpled surface on the flow director base plate.

FIG. 6*a* is a perspective view of an alternate embodiment of the current invention, comprising a flow director base plate 120 of generally trapezoidal shape, having a base plate leading edge 122 at the minor trapezoid end and a base plate trailing edge 124 at the major trapezoid end, each edge shaped to minimize turbulence, and a first base plate mounting hole 126 about 1-inch below the base plate leading edge 122 and a second base plate mounting hole 126 having a center about 1½-inches from the center of the first base plate mounting hole 126, where the base plate mounting holes 126 are aligned along the water flow path (not shown). Additionally, FIG. 6*a* depicts the alternate embodiment of the current invention having a dimples 150 across the flow director base plate 120 surface to induce a water boundary layer for creating further laminar flow across the base plate 120 surface, thus improving reverse thrust capabilities.

Figure 6B:
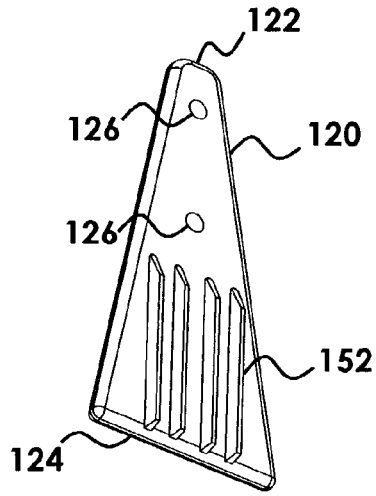
FIG. 6*b* is a perspective view of an alternate embodiment of the reverse gate flow director having splines along the water flow path of the flow director base plate.

FIG. 6*b* is a perspective view of an alternate embodiment of the current invention, comprising a flow director base plate 120 of generally trapezoidal shape, having a base plate leading edge 122 at the minor trapezoid end and a base plate trailing edge 124 at the major trapezoid end, each edge shaped to minimize turbulence, and a first base plate mounting hole 126 about 1-inch below the leading edge of the flow director 110 and a second base plate mounting hole 126 having a center about 1½-inches from the center of the first base plate mounting hole 126, where the base plate mounting holes 126 are aligned along the water flow path (not shown). Additionally, the alternate embodiment of the current invention has splines 152 on the base plate 122 surface and parallel with the water flow path (not shown) to induce a directed water flow from the reverse gate flow director 110, thus improving the reverse thrust capabilities.

Figure 6C:
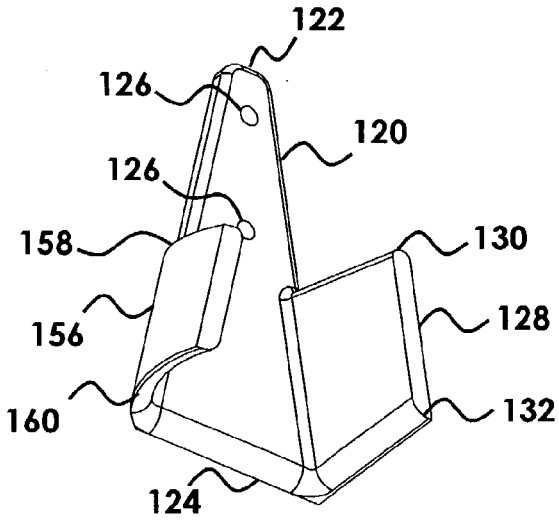
FIG. 6*c* is a perspective view of an alternate embodiment of the reverse gate flow director having a flow director fin on one flow director base plate edge and a shaped flow director fin on another flow director base plate edge.

FIG. 6*c* us a perspective view of an alternate embodiment of the current invention, a flow director base plate 120 of generally trapezoidal shape, having a base plate leading edge 122 at the minor trapezoid end and a base plate trailing edge 124 at the major trapezoid end, each shaped to minimize turbulence, and a first base plate mounting hole 126 about 1-inch below the leading edge of the flow director 110 and a second base plate mounting hole 126 having a center about 1½-inches from the center of the first base plate mounting hole 126, where the base plate mounting holes 126 are aligned along the water flow path. The alternate embodiment further comprises a flow director fin 128 of generally rectangular shape and positioned about ⅔ along one side of the down stream length of the base plate 120, having a flow director fin leading edge 130 beginning about ⅓ the flow director base plate 120 length from the base plate leading edge 122, and a flow director fin trailing edge 132, terminating at the base plate trailing edge 124, each edge shaped to minimize turbulence, where the flow director fin 128 laterally directs the reverse thrust water (not shown) towards the side of the stern-panel 104. Further, the flow director fin 128 enables improved steering during reverse thrust operation by improving the laminar flow of the reverse thrust water stream (not shown) and directing the output flow to reduce stern-panel 104 interaction. Additionally, the flow director base plate 120 is configured to improve laminar flow of reverse thrust water (not shown) and configured to focus reverse thrust water below the stern-panel 104 for improved jet boat 102 reverse operation. Additionally, the alternate embodiment of the current invention has a shaped flow director fin 156 that is curved to match the contoured "round" side of the reverse gate exit port 114, and the shaped flow director fin 156 abuts the edge of the reverse gate exit port. The shaped flow director fin 156 has a shaped flow director leading edge 158 contoured to reduce turbulence and a shaped flow director trailing edge 160 contoured to minimize turbulence. The shaped flow director fin 156 provides additional focusing of the water flow (not shown) to improve reverse thrust. Additionally, the open span between the flow director fin 128 and the shaped flow director fin 156 enables the focused water flow (not shown) to reflect off the flow director base plate 120 and flow beneath the stern-panel 114 for improved reverse thrust and improves reverse steering performance.

Figure 6D:
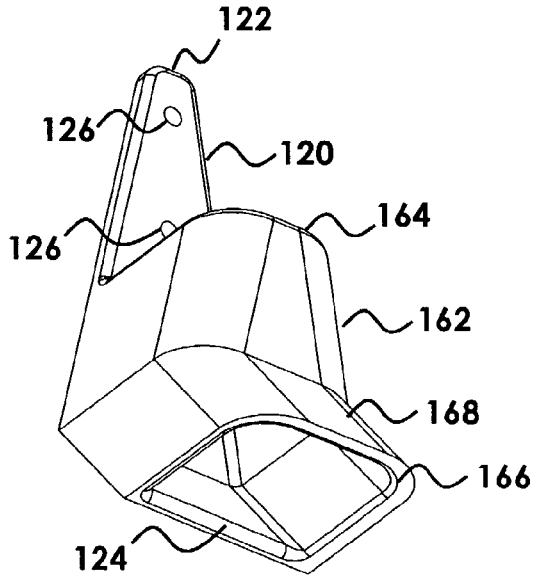
FIG. 6*d* is a perspective view of an alternate embodiment of the reverse gate flow director having a flow director tube attached to the flow director base plate.

FIG. 6*d* is a perspective view of an alternate embodiment of the current invention, shown is a flow director base plate 120 of generally trapezoidal shape, having a base plate leading edge 122 at the minor trapezoid end and a base plate trailing edge 124 at the major trapezoid end, each edge shaped to minimize turbulence, and a first base plate mounting hole 126 about 1-inch below the leading edge of the flow director 110 and a second base plate mounting hole 126 having a center about 1½-inches from the center of the first base plate mounting hole 126, where the base plate mounting holes 126 are aligned along the water flow path (not shown). The alternate embodiment further comprises a flow director tube 162 fixedly attached to the flow director base plate 120. The flow director tube 162 has a flow director tube leading edge 164 and a flow director tube trailing edge 166, each edge shaped to minimize turbulence. The flow director tube further comprises an angled flow director tube deflector 168 extending form the flow director base plate 120. The flow director tube is generally shaped to direct water flow beneath the stern panel 114 and around a side of the stern panel 114 to enable improved reverse thrust from the jet pump 106. Additionally, the flow director tube 162 is contoured to focus water flow and further improve reverse thrust.

It is within the scope of the current invention to include any combination of the above features depicted in the above drawings. For example, a combination could include the features of FIG. 5*a* with the angled deflector plates of FIG. 5*c*, and with the dimpled 150 base plate 120 of FIG. 6*a* and with the splines 152 of FIG. 6*b*, where the dimpled 150 surface of FIG. 6*a* and the splines 152 of FIG. 6*b* could further be used on the flow director fin 128 of FIG. 5*c* or of FIG. 5*a*. Other examples include combining the contoured deflector fin 156 of FIG. 6*c* of the flow director tube 162 with the dimpled aspects of FIG. 6*a*.

Figure 7A:
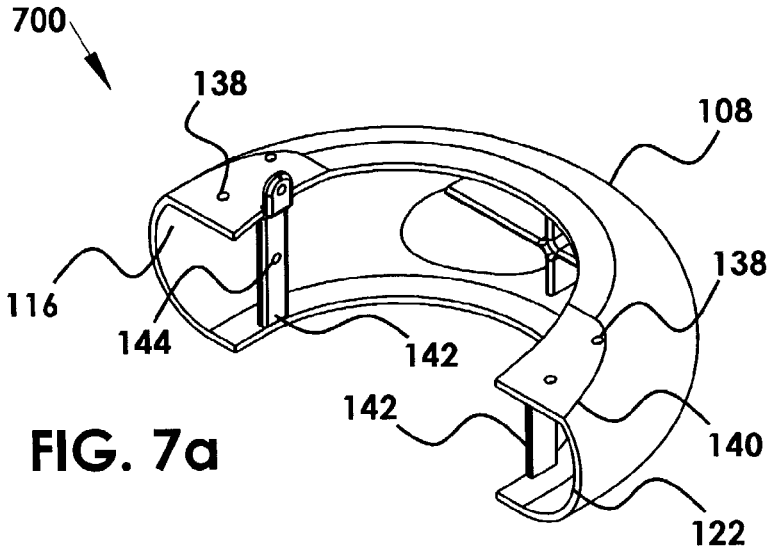
FIG. 7*a* is a perspective view of a reverse gate configured for mounting the reverse gate flow director.

FIG. 7*a* is a perspective view of a reverse gate 108 configured for receiving the reverse gate flow director 110 invention, where, as depicted, the reverse gate 108 has reverse gate mounting holes 138 drilled through the reverse gate deflection feature 140 and separated by about 1½-inches and aligned parallel with the water flow direction. Further depicted is the reverse gate mounting posts 142, having a jet pump housing mounting hole 144 for attaching the reverse gate 108 to the jet pump housing 106. The reverse gate cavity 116, the reverse gate mounting post 142 and the reverse gate deflection feature 140 define the reverse gate exit port 114 profile. The embodiments of the reverse gate flow director 110 have features and profiles for conforming to the inner reverse gate exit port 114 profile and fixedly attaching therein.

Figure 7B:
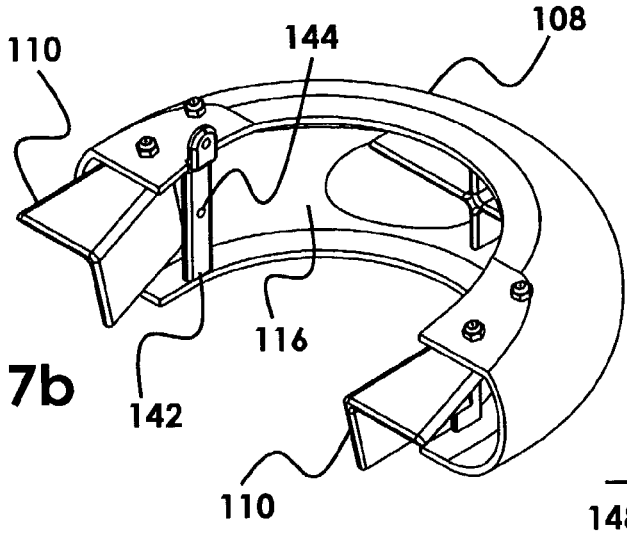
FIG. 7*b* is a perspective view of a reverse gate having the reverse gate flow director fixedly attached to each exit port of the reverse gate.

FIG. 7*b* depicts a perspective view of a reverse gate 108 having the reverse gate flow director 110 invention fixedly attached to each of the reverse gate deflection features 140 of the reverse gate 108. The flow director fin 128 is attached to the flow director base plate 120 at an angle suitable to conforming to the inner reverse gate exit port 114 profile. The reverse gate flow director 110 fits within the reverse gate cavity 116 and the flow director fin 128 fits inside the reverse gate mounting post 142, and the reverse gate mounting post 142 is depicted having a jet pump housing mounting hole 144 for pivotally attaching to the jet pump housing 106.

Figure 7C:
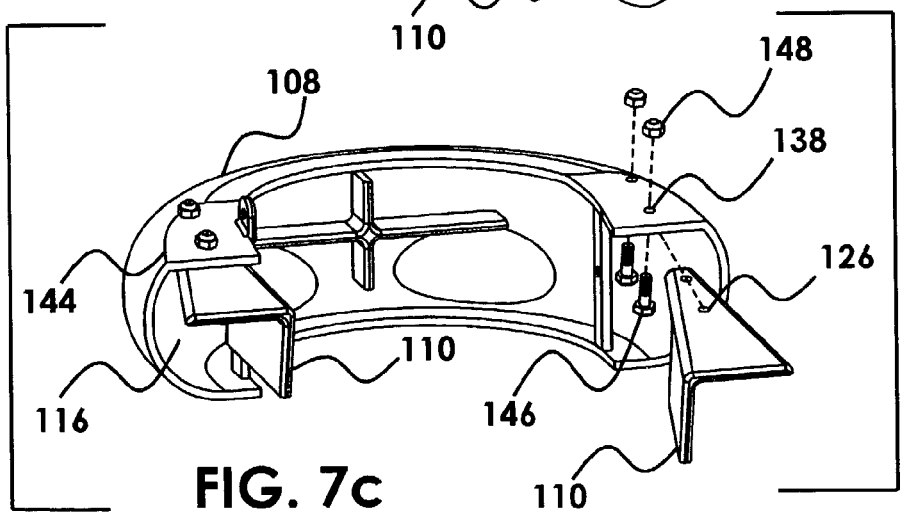
FIG. 7*c* is a partially exploded perspective view of a reverse gate and the reverse gate flow directors.

FIG. 7*c* is a partially exploded perspective view of the reverse gate 108 and reverse gate flow director 110, where the image depicts one reverse gate flow director 110 fixedly attached to the reverse gate deflection feature 140 using flow director mounting bolt 146 inserted through the reverse gate mounting holes 138 on the reverse gate deflection feature 140 of the reverse gate 108 and the base plate mounting holes 126 of the reverse gate flow director 110, and fixedly secured with a flow director mounting nut 148. Further depicted is the opposing reverse gate flow director 110 removed from the reverse gate deflection feature 140 to illustrate the assembly components including flow director 110 mounting bolts 146 and mounting nuts 148.

The above-described embodiments are set forth by way of example and are not for the purpose of limiting the present invention. It will be readily apparent to those skilled in the art that obvious modifications, derivations and variations can be made to the embodiment(s) without departing from the scope of the invention. Accordingly, the claims appended hereto should be read in their full scope including any such modifications, derivations and variations.

What is claimed is:

1. A reverse gate flow director comprising:

a flow director base plate of generally trapezoidal shape and mounting holes and having a mounting side and a water flow side; and a flow director base plate leading edge configured to minimize turbulence; and a dimpled surface across the flow side of the flow director base plate configured to create a boundary layer to minimize turbulence; and flow director splines along the length of the flow director base plate to direct jet pump water flow; and an angled base plate deflector configured to further direct jet pump water flow and having a dimpled surface to create a boundary layer to minimize turbulence and having splines along the water flow path to further direct water flow; and a flow director fin, having a leading edge to minimize turbulence beginning at the base plate leading edge, and a flow director fin having a trailing edge configured to minimize turbulence and terminating at the flow director base plate trailing edge, attached to the flow director base plate at an angle suitable to conform to the inside profile of the reverse gate and longitudinal to the flow director base plate edge and configured for fitting inside a jet boat reverse gate having a deflection feature; and an angled fin plate deflector configured to further direct jet pump water flow and having a dimpled surface to create a boundary layer to minimize turbulence and having splines along the jet pump water flow path to direct water flow.

2. The reverse gate flow director of claim 1 is fixedly mounted to a jet pump reverse gate having a reverse gate deflection feature with mounting holes configured for receiving mounting bolts through the reverse gate mounting holes and through the flow director base plate mounting holes and fixedly secured thereto with flow director mounting bolts and flow director mounting nuts.

3. A reverse gate flow director and distinct from a reverse gate comprising a base plate of generally trapezoidal shape having a first end for fixedly mounting to the reverse gate using a plurality of mounting bolts inserted through a plurality of mounting holes in the base plate and inserted through mounting holes in a reverse gate deflection feature, and further comprising a second end for holding a plurality of flow director fins abutted to a reverse gate exit port for directing water flow emitting from the reverse gate exit port beneath a stern-panel to improved jet boat reverse.

4. The reverse gate flow director of claim 3 further comprises a first base plate mounting hole about 1-inch below the base plate first end a second base plate mounting hole having a center about 1½-inches from the center of the first base plate mounting hole, where the base plate mounting holes are aligned along the water flow path.

5. The reverse gate flow director of claim 3 where the flow director fin is generally rectangular shape and positioned about ⅔ along one side of the down stream length of the base plate; and a. having a flow director fin leading edge beginning about ⅓ along the flow director base plate length from the base plate leading edge shaped to minimize turbulence; and b. a flow director fin trailing edge, terminating at the base plate trailing edge and shaped to minimize turbulence, where the flow director fin laterally directs the reverse thrust water towards a side of the stern-panel.

6. The reverse gate flow director of claim 3 where the flow director base plate has an angled base plate deflector and the flow director fin has an angled fin plate deflector for deflecting water emanating from the reverse gate exit port beneath the jet boat stern-panel for improved jet boat reverse.

7. The reverse gate flow director of claim 3 where the flow director has dimples across the base plate surface and fin surfaces to induce a water boundary layer for creating laminar flow.

8. The reverse gate flow director of claim 3 where the flow director has splines along the base plate and fin surfaces and parallel with the water flow path to induce a directed water flow from the reverse gate.

9. The reverse gate flow director of claim 3 where the plurality of flow director fins comprise a first flow director fin of generally rectangular shape and a second flow director fin shaped to match the contour of the reverse gate exit port, wherein the fins abut the edge of the reverse gate exit port and enable focused water flow.

10. The reverse gate flow director fins of claim 9 where an open span between the rectangular flow director fin and the shaped flow director fin enables water flow to reflect off the flow director base plate and flow beneath the stern-panel for improved reverse thrust and reverse steering performance.

11. The reverse gate flow director of claim 3 where the flow director fin comprises a flow director tube fixedly attached to the flow director base plate and contoured to match the reverse gate exit port profile and having a leading edge and a trailing edge shaped to minimize turbulence.

12. The reverse gate flow director of claim 3 where the flow director fin comprises an angled flow director tube deflector extending from the flow director base plate generally shaped to direct water and focus water flow to improve reverse thrust.

13. The reverse gate flow director of claim 3 wherein the base plate is of generally trapezoid shape having a base plate leading edge at the minor trapezoid end and a base plate trailing edge at the major trapezoid end, each shaped to minimize turbulence.

14. The reverse gate flow director of claim 3 wherein the flow director fins have a shaped leading edge and a shaped trailing edge to reduce turbulence.

15. The reverse gate flow director of claim 3 further comprising an open span between the flow director fins to enable water flow to reflect off the flow director base plate and flow beneath the stern-panel for improved reverse thrust and reverse steering performance.

16. A reverse gate flow director and distinct from a reverse gate comprising a base plate having a first end for fixedly mounting to the reverse gate and a second end for holding a flow director tube to a reverse gate exit port for directing water flow emitting from the reverse gate exit port below a jet boat stern panel to enable improved reverse thrust.

17. The reverse gate flow director of claim 16 further comprises dimples across the flow director base plate and tube surfaces to induce a water boundary layer for creating laminar flow and improving reverse thrust capabilities.

18. The reverse gate flow director of claim 16 further comprises splines on the base plate and tube surfaces and parallel with the water flow path to induce a directed water flow from the reverse gate flow director and improving reverse thrust capabilities.

19. The reverse gate flow director of claim 16 where the flow director tube further comprises an angled flow director tube deflector generally shaped to focus and direct water flow beneath the stern panel to enable improved reverse thrust.

20. The reverse gate flow director of claim 16 wherein the flow tube extends from about ⅓ along the flow director base plate length from the base plate leading edge, and positioned about ⅔ along the down stream length of the base plate and having a tube leading edge beginning about ⅓ along the flow director base plate length from the base plate leading edge shaped to minimize turbulence and terminating at the base plate trailing edge.

* * * * *